US009840828B2

(12) United States Patent
Bierwith

(10) Patent No.: US 9,840,828 B2
(45) Date of Patent: Dec. 12, 2017

(54) CONTAINER LIP FOR EXCAVATING EQUIPMENT PROVIDING IMPROVED MATERIAL FLOW OVER LIP

(76) Inventor: Robert S. Bierwith, Alameda, CA (US)

( * ) Notice: Subject to any disclaimer, the term of this patent is extended or adjusted under 35 U.S.C. 154(b) by 0 days.

(21) Appl. No.: 13/478,053

(22) Filed: May 22, 2012

(65) Prior Publication Data

US 2013/0047475 A1 Feb. 28, 2013

Related U.S. Application Data

(60) Provisional application No. 61/489,626, filed on May 24, 2011.

(51) Int. Cl.
*E02F 9/28* (2006.01)
*E02F 3/40* (2006.01)

(52) U.S. Cl.
CPC ..... *E02F 9/2825* (2013.01); *E02F 3/40* (2013.01); *E02F 9/2883* (2013.01); *Y10T 29/49826* (2015.01)

(58) Field of Classification Search
CPC ..... E02F 9/28; E02F 9/2816; E02F 9/2825; E02F 9/2858
USPC ..... 37/452, 545, 455, 450
See application file for complete search history.

(56) References Cited

U.S. PATENT DOCUMENTS

| | | | | |
|---|---|---|---|---|
| 1,126,319 | A * | 1/1915 | Vanderhoef et al. | 37/342 |
| 1,507,697 | A * | 9/1924 | Crane | 37/454 |
| RE16,120 | E * | 7/1925 | Honstain | 37/454 |
| 1,959,847 | A * | 5/1934 | Van Buskirk | 37/450 |
| 2,005,016 | A * | 6/1935 | Van Buskirk | 37/452 |
| 3,388,488 | A * | 6/1968 | Duplessis | 37/452 |
| 4,180,926 | A * | 1/1980 | Klett | E02F 9/2833 37/455 |
| 4,208,815 | A | 6/1980 | Yunker et al. | |
| 4,357,765 | A * | 11/1982 | Seykora | 37/455 |
| 4,481,728 | A | 11/1984 | Mulder et al. | |
| 5,713,145 | A | 2/1998 | Ruvang | |
| 6,986,216 | B2 | 1/2006 | Emrich et al. | |
| 7,536,811 | B2 * | 5/2009 | McClanahan | 37/455 |
| 7,559,162 | B2 * | 7/2009 | Bierwith | 37/444 |
| 2004/0107608 | A1 | 6/2004 | Meyers et al. | |
| 2007/0051022 | A1 * | 3/2007 | Meyers et al. | 37/455 |
| 2013/0000162 | A1 * | 1/2013 | Renski | 37/456 |
| 2013/0086826 | A1 * | 4/2013 | Renski et al. | 37/452 |

OTHER PUBLICATIONS

International Search Report and Written Opinion dated Aug. 3, 2012, for PCT Patent Application No. PCT/US2012/039193, 16 pages.
International Preliminary Report on Patentability dated Dec. 5, 2013, for PCT Patent Application No. PCT/US2012/039193, 7 pages.

* cited by examiner

*Primary Examiner* — Robert Pezzuto
*Assistant Examiner* — Jessica H Lutz
(74) *Attorney, Agent, or Firm* — Kilpatrick Townsend & Stockton LLP

(57) ABSTRACT

A lip to be applied to a bucket of excavating equipment for moving ground materials that includes a lip adapted to be attached to an open end of a container of the excavating equipment having a front end facing in a forward direction of the container, the lip defining a substantially horizontal bottom lip portion and side portions extending upwardly from lateral ends of the bottom lip portion, and a multiplicity of like projections extending forwardly relative to the lip from at least one of the portions of the lip.

5 Claims, 6 Drawing Sheets

CONTAINER LIP FOR EXCAVATING EQUIPMENT PROVIDING IMPROVED MATERIAL FLOW OVER LIP

CROSS-REFERENCES TO RELATED APPLICATIONS

This application claims the benefit of U.S. Provisional Patent Application No. 61/489,626, filed on May 24, 2011, the full disclosure of which is incorporated herein by reference.

BACKGROUND OF THE INVENTION

Ground excavating equipment for moving/removing ground materials such as rock, sand, mineral deposits and the like (hereafter generally "ground") typically has a bucket or container with an open front end that is forced into the ground to scoop up a load of ground. To facilitate digging into the ground, the sides and lower edge of the open bucket end are defined by a lip, suitably secured to the accompanying bucket, which mounts a variety of ground contacting components such as digging teeth and shrouds, for example.

To protect the lip from wear and tear while permitting the intermittent replacement of worn teeth, the latter are normally removably secured to an adapter, with wedges, bolts, etc., so that the worn teeth can be replaced. The adapters are in turn removably mounted to the lip of the bucket so that they can also be replaced when worn, or to secure a different component to the lip that requires its own adapter. In this manner, the costly bucket lip is protected against wear to the maximum extent possible.

In the past, reconnection of the adapter or component to the lip has been problematic because it is subjected to large forces, high loads, shock, vibration and contamination by abrasive materials, all of which have the tendency of inadvertently loosening or freezing the connection. Both are undesirable because they make it more difficult, time-consuming and costly to replace adapters, teeth and/or other components mounted to the lip at the front end of the bucket and/or cause equipment down-time.

An additional difficulty encountered with bucket lips is that the lip must be capable of receiving and holding components of widely differing shapes and/or sizes and at different positions over the length of the horizontal and upwardly extending sides of the lips. In some instances, the lips were provided with forwardly extending projections positioned and configured to place particular components at predetermined locations along the lip. Such lips were ill-adapted for placing the components at different locations where, for example, the needed projection to mount a given component is not available. Alternatively, the operator of the equipment can be provided with a supply of adapters which are configured so that they can be placed over the length, or part of the length, of the lip. A big disadvantage of such an arrangement is the need to store and keep track of a relatively large supply of parts, which is costly to acquire as well as to install.

Finally, conventional ground excavating equipment typically employed straight, oval, rounded and/or threaded wedge members which had to engage tightly fitting, overlapping bores in the adapter and the lip to keep the adapter firmly in place in the rough environment in which excavating equipment operates. Such wedge-like members are time-consuming to install and difficult to remove, which renders them costly and therefore undesirable.

BRIEF SUMMARY OF THE INVENTION

The present invention provides a releasable connection between components, such as adapters for teeth and shrouds, which must be attached to the lip at a forward end of the container for ground excavating equipment. The lip has regularly spaced projections at and along its front edge over which the components, e.g. an adapter, are slipped. The lip has a bulbous cross-section aft of the front edge of the lip which gives the lip a maximum thickness at a point aft of the front edge of the lip. As a result, the cross-section of the lip first increases from the lip edge in the aft direction and then again decreases. The resulting hump in the cross-section of the lip facilitates the secure, firm, stable and easily releasable connection between the adapter and the lip.

Thus, a lip constructed in accordance with the present invention is applied to the open front end of the bucket of excavating equipment for moving ground material and has a front edge that faces in the forward direction of the container. The lip defines a substantially horizontal bottom lip portion and side lip portions which extend upwardly from lateral ends of the bottom portion. A multiplicity of like projections extend forwardly relative to the lip from at least one, and typically from all, of these portions of the lip. Top and bottom surfaces of the lip extend in the aft direction from the front edges of the lip portions. First sections of the top and bottom surfaces which are contiguous with the front edge converge in a forward direction, and second sections of the top and bottom surfaces located aft of the first section diverge relative to each other in a forward direction towards the end of the first sections. A component releasably applied over the lip frequently is an adapter which has upper and lower legs in contact with the top and bottom surface sections of the lip. The relatively longer lower leg has an upwardly facing surface shaped complementary to and in contact with the first and second sections of the bottom surface of the lip. Bolts or like fasteners secure the ends of the adapter legs to the lip to keep it firmly in place.

Aside from providing a stable, secure connection between the lip and the adapter, the portions of the shroud, adapters and the like overlying the top surface of the lip are relatively smooth and do not obstruct ground material that is being scooped up by the teeth and the shrouds between the teeth and then flows over the teeth, adapters and the shrouds into the container. As a result, no ground material tends to build up at and just behind the components mounted to the front edge of the lip, which enhances the efficiency of the lip for moving ground materials.

DETAILED DESCRIPTION OF THE INVENTION

Figure 1:
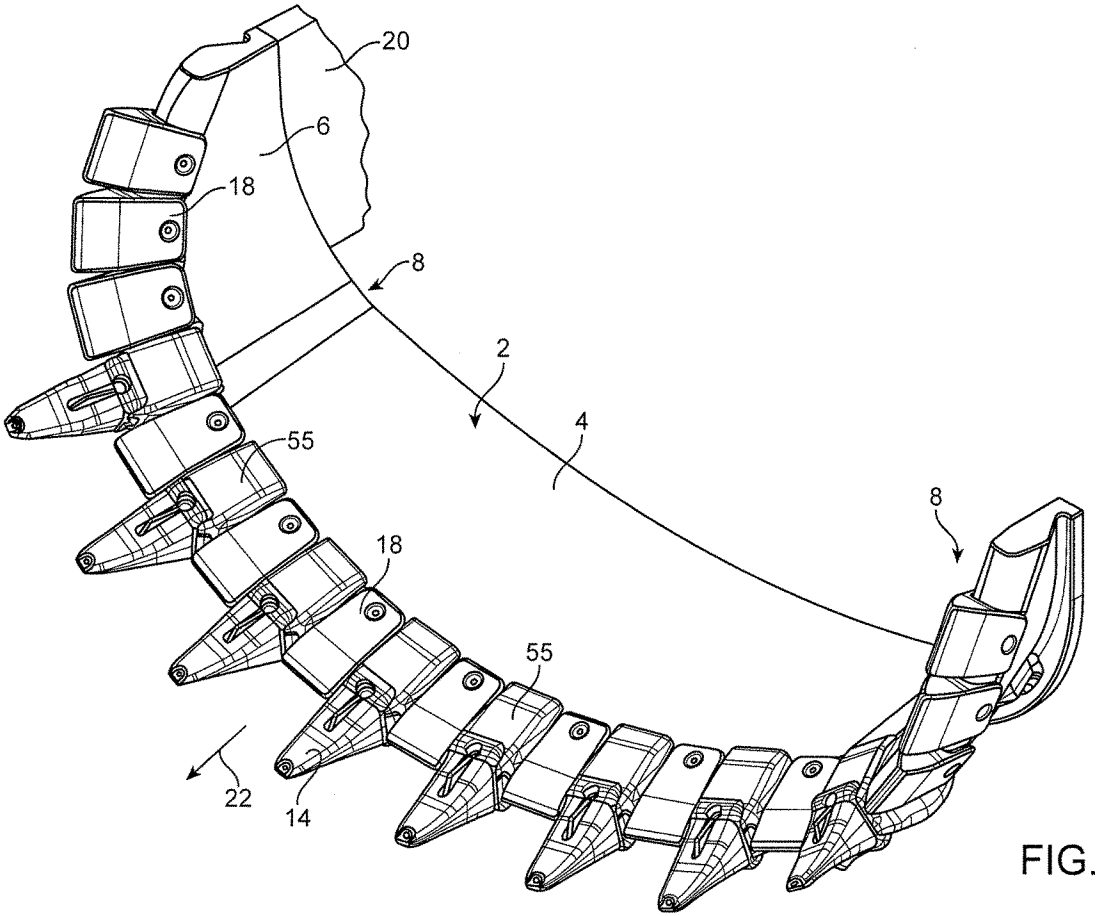
FIG. 1 is a perspective view of a lip made in accordance with the present invention for a container of excavating equipment.
Figure 2:
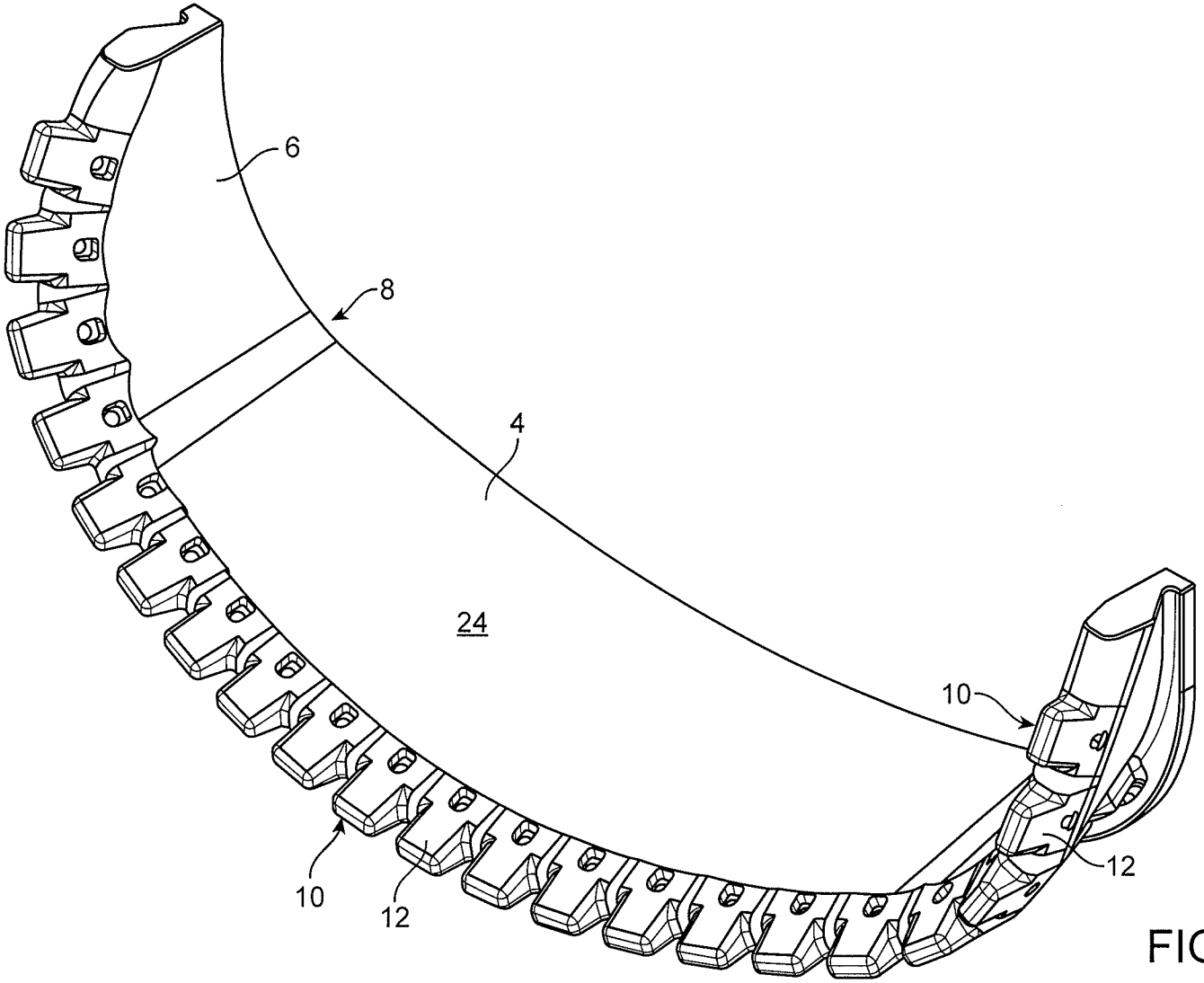
FIG. 2 is a view similar to FIG. 1 and shows the lip only.
Figure 3:
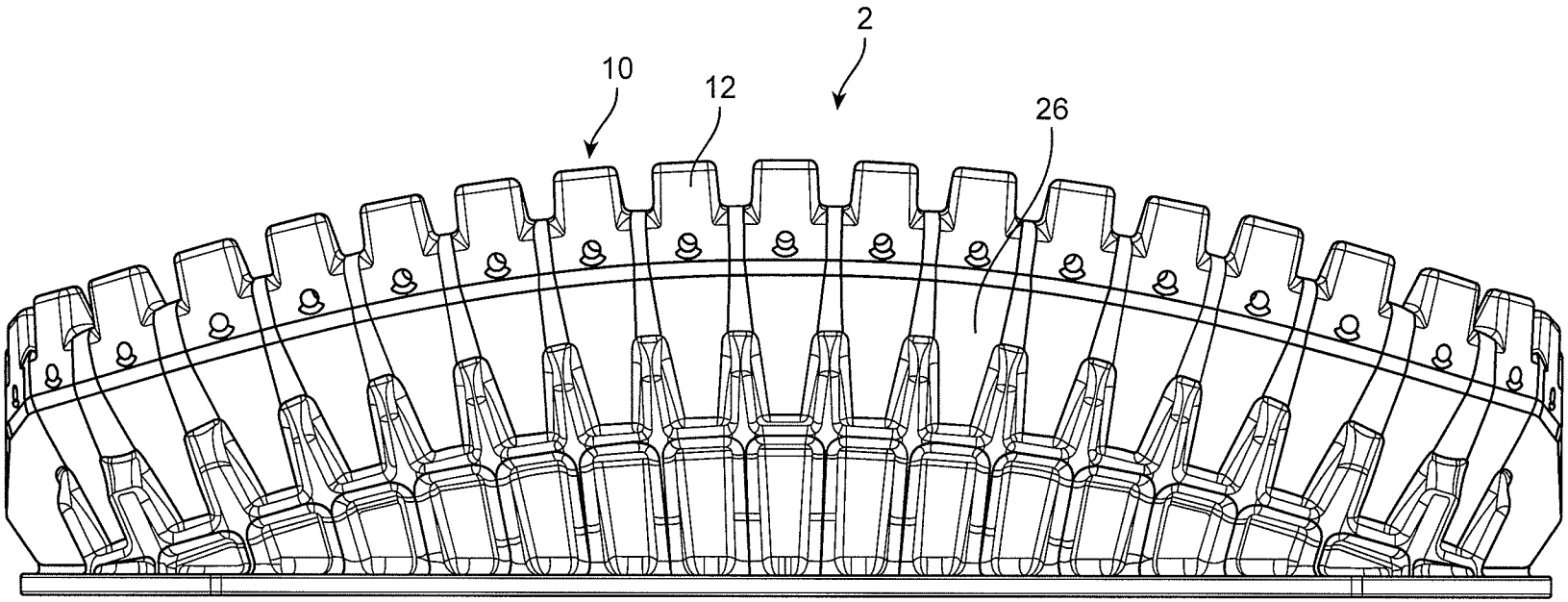
FIG. 3 is a plan view of the underside of the lip shown in FIG. 1.

Referring to FIGS. 1-3, a lip 2 constructed according to the present invention has a relatively flat bottom 4 with lip sides 6 extending upwardly from lateral ends 8 of the lip bottom. The lip has a front edge 10 that is defined by a multiplicity of projections 12 arranged along the length of the front edge extending in a forward direction. Teeth 14 mounted on adapters 16 (shown in FIG. 5) and shrouds 18 are secured to the projections, as is further described below. The lip as such is secured, e.g. welded, to an open forward end of a container or bucket 20 of the excavating equipment. In use, the bucket is moved in a forward direction 22 and the front end 10 of the lip, including the teeth 14 thereon, digs into the ground as the bucket is driven forwardly. This causes ground to flow over the top surface of the teeth, shrouds and the lip into the container. Neither the teeth, the adapters nor the shrouds constitute an obstacle for the ground to smoothly move over them into the bucket without forming obstructions by compacted ground, stones, rocks and the like in the vicinity of the lip, because there is a substantially smooth, non-obstructing transition between the components on the front of the lip and the remainder of the lip and the container, as will be apparent from the following.

Figure 4:
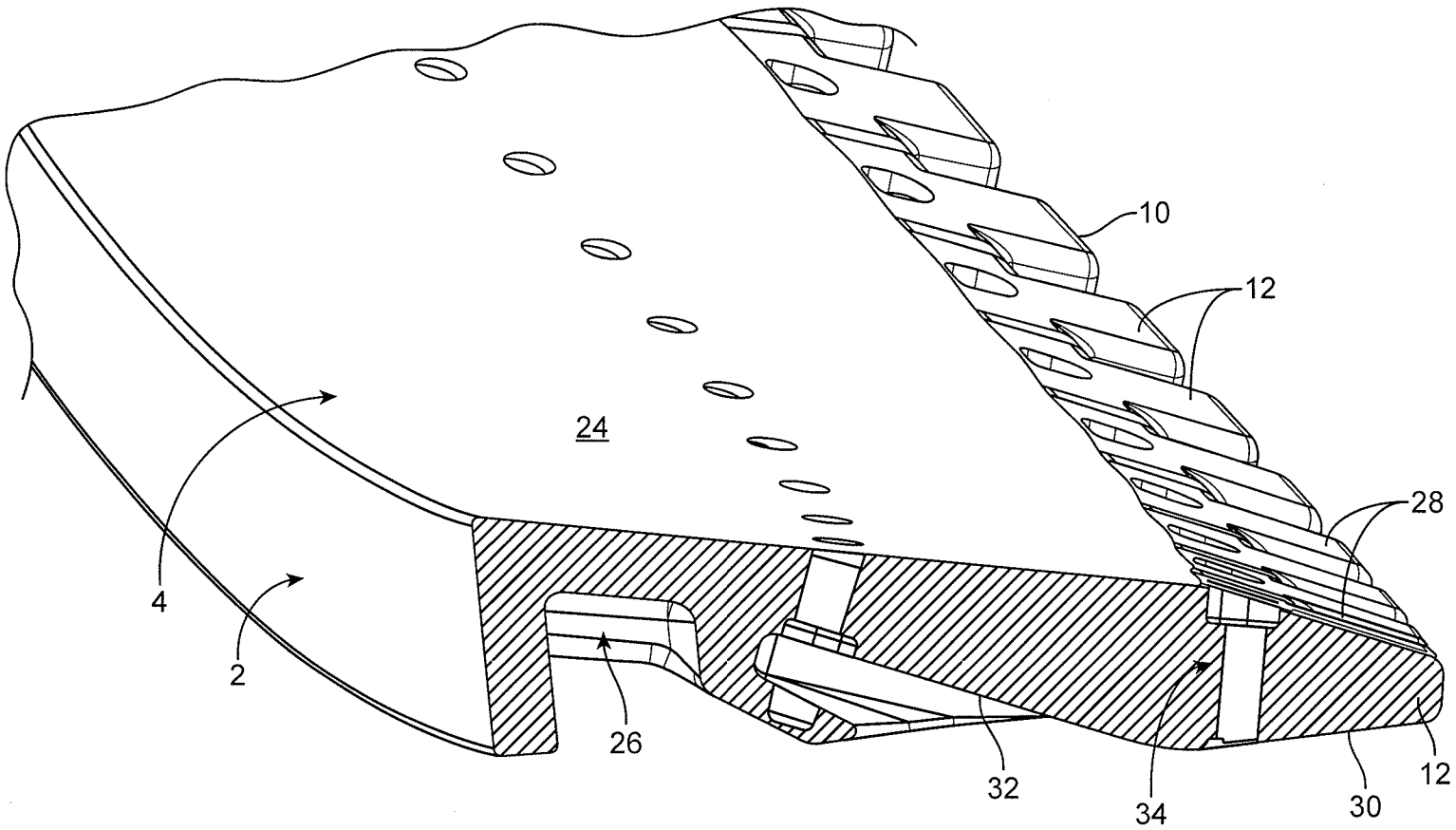
FIG. 4 is a partial, side elevational view which shows the cross-section of the lip.

Referring to FIG. 4, lip 2 defines a top surface 24 and a bottom surface 26, which, at their respective forward parts, form first upper and lower surface sections 28, 30 which diverge in the aft or rearward direction beginning at the front edge of the lip (defined in part by projections 12). The substantially flat, smooth bottom surface 26 of the lip begins where the outwardly inclined section 28 ends. The downwardly inclined lower section 30 becomes inclined outwardly at a location aft of the lip front edge 10 and approximately below where the upper section 28 and the top surface 24 intersect. As a result, the cross-section of the lip initially increases in the aft direction from the lip front edge 10 and then decreases because a second, lower section 32 of the bottom surface 26 is angularly inclined relative to and extends rearwardly towards the upper surface 24 as can be seen in FIG. 4. As a result, the lip forms a bulbous enlargement 34 of the cross-section of the lip some distance aft of the front edge of the lip.

Figure 5:
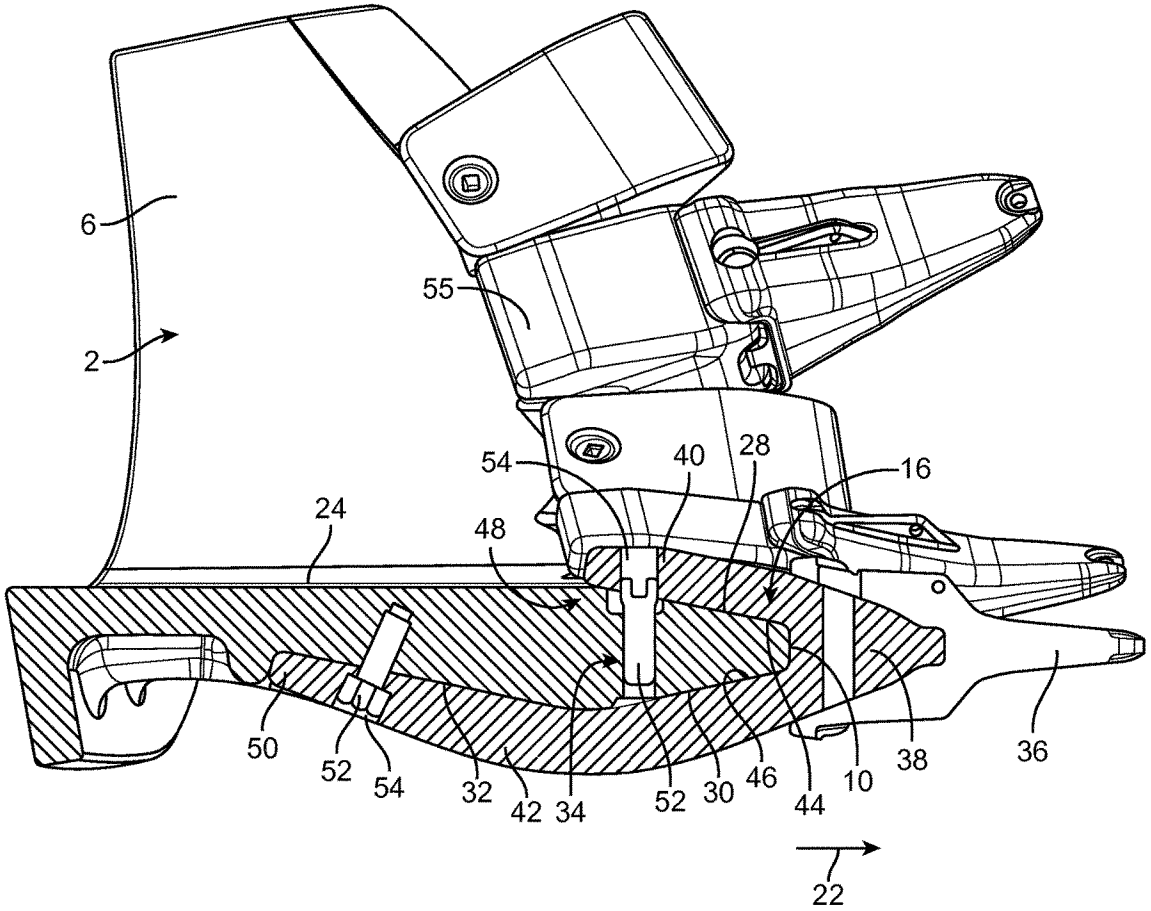
FIG. 5 is a cross-section through the lip to which an adapter carrying a tooth is mounted.
Figure 6:
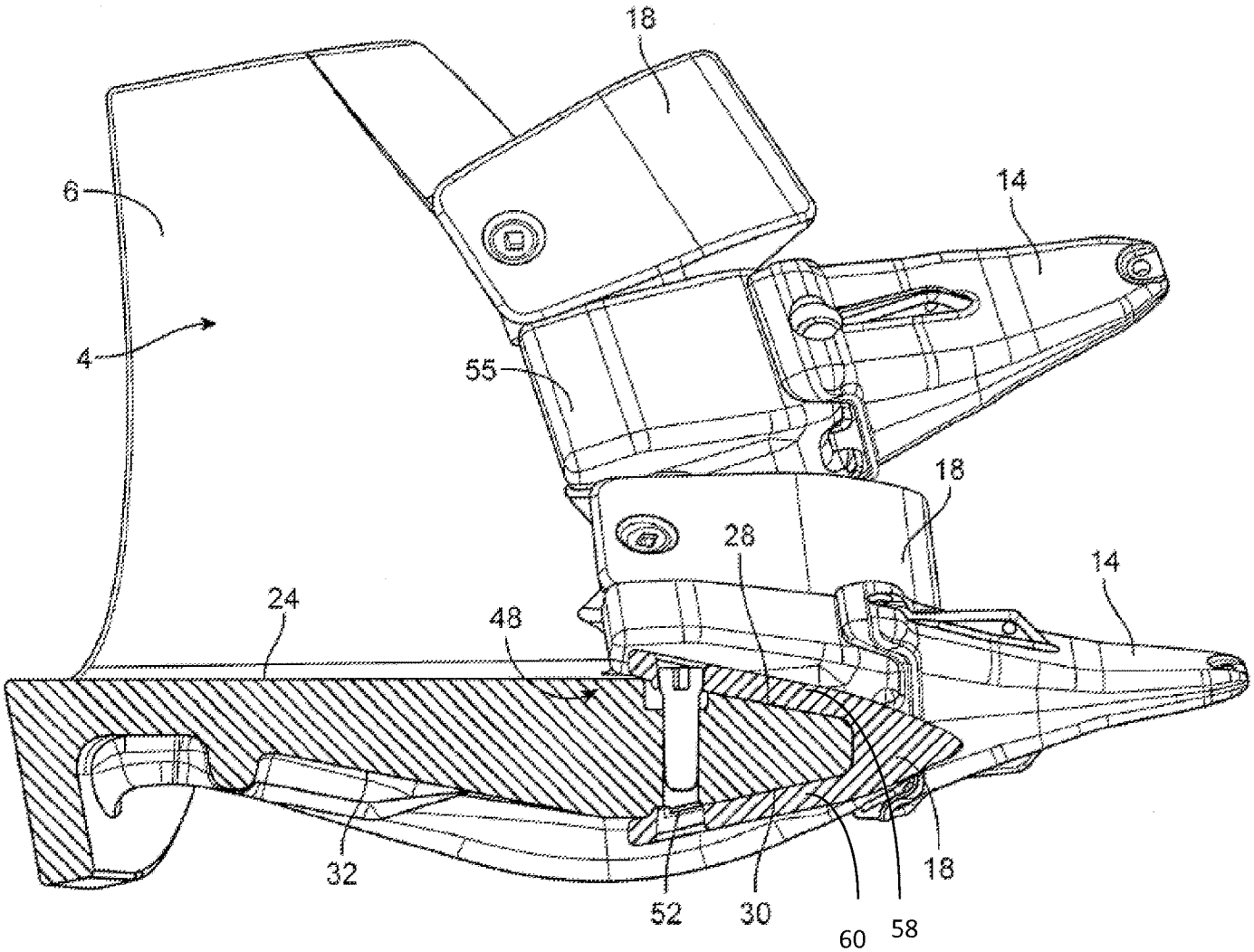
FIG. 6 is a cross-section similar to FIG. 5 and shows a shroud mounted on the lip.

Referring to FIGS. 5 and 6, a digging tooth 36 is conventionally detachably secured to a front end of adapter 16. The adapter has a main, forward body 38 from which spaced-apart upper and lower legs 40, 42 extend in the aft direction. The upper leg has a surface 44 facing the lip which is shaped and oriented complementary to upper surface section 28 of the lip (defined by projections 12). Likewise, the lower leg 42 of the adapter has a surface 46 which is shaped and oriented complementary to lower surface section 30 of the lip.

In the area 48 generally below where inclined surface 28 and top surface 24 meet, and where the second lower surface section 32 begins, an aft portion 50 of the lower adapter leg is angled upwardly in the aft direction, and the surface of the lower leg opposite thereto is shaped and oriented complementary to the second lower section 32 of the lip. Bolts 52 or similar fasteners extend through appropriate holes 54 in the legs of the adapter, suitably, e.g. threadably, engage the lip, and releasably secure the legs to the lip adjacent the aft ends of the legs, as is shown in FIG. 5. Bolt configurations as shown and described, for example, in published U.S. patent application No. US-2010-0162594-A1, which is incorporated herein by reference, are well suited for this purpose.

Upper and lower adapter legs 40, 42 effectively cradle and embrace the bulbous enlargement 34 of the lip in a mechanically locking configuration. When the connecting bolts are tightened, they slightly deflect the legs and press them against the bulbous enlargement of the lip which provides enhanced stability for the connection and prevents its undesired loosening. At the same time, the adapter is readily and quickly removed from and installed on a projection of the lip by removing the bolts with a wrench or the like manually and/or with hand tools by sliding, wiggling and/or twisting the adapter legs generally sideways relative to the bulbous enlargement 34 to disengage the legs from the lip.

In a preferred embodiment, a flat cap 55 can be applied over the upper leg of the adapter. This protects the head of the screw during use of the excavator and forms a smooth, substantially continuous surface from the teeth to the top surface 24 of the lip, which further facilitates the flow of ground material over and past the lip into the container.

FIG. 6 is a view substantially identical to FIG. 5 but shows a cross-section through the lip and a shroud 18 mounted on those lip projections 12 which do not receive an adapter. The shroud has upper and lower rearwardly extending legs 58, 60 which are in contact with the upper and lower, inclined lip front sections 28, 30 in the same manner in which the legs 40, 42 of adapter 16 shown in FIG. 5 contact the lip, as was described above. A bolt 52 extends through a hole 54 in the upper leg of the shroud and removably secures the latter to the lip.

What is claimed is:

1. A lip assembly to be applied to a front end of a bucket of excavating equipment for moving ground materials, the bucket front end facing in a forward direction, the lip assembly comprising:

a lip comprising:

a substantially horizontal bottom portion;

side portions extending upwardly from lateral ends of the bottom portion; and a plurality of projections extending from the bottom and side portions;

wherein the lip includes a top surface and a bottom surface, both of the top and bottom surfaces extending in an aft direction from front ends of the plurality of projections, wherein first top and bottom surface sections, respectively of each of the top and bottom surfaces, converge in an aft direction from an enlarged portion of the lip, wherein second top and bottom surface sections respectively of each of the top and bottom surfaces diverge relative to each other in the aft direction from the front ends of the plurality of projections to the enlarged portion of the lip, and wherein the enlarged portion of the lip comprises a bulbous enlargement of the cross-section of the lip located aft of the lip edge;

an excavating equipment component attached to at least one of the plurality of projections, the excavating equipment component having spaced-apart upper and lower legs that extend rearwardly from the front end of the lip, the upper leg having an upper lip engaging surface which is shaped complementary to the second top surface section, and the lower leg having a lower lip engaging surface which is shaped complementary to the first and second bottom surface sections;

a first fastener which penetrates the upper leg and extends into the second top surface section; and a second fastener which penetrates the lower leg and extends into the first bottom surface section and causes the lower leg to deflect toward the upper leg and embrace the bulbous enlargement forming a mechanical lock preventing movement of the excavating equipment component relative to the lip.

2. The lip assembly according to claim 1 wherein the lower leg forms a substantially round concave surface shaped to be complementary to the first and second sections of the bottom surface.

3. The lip assembly according to claim 2 wherein the lower leg is longer in an aft direction as measured from the front end of the lip than the upper leg.

4. The lip assembly according to claim 1 wherein the excavating equipment component comprises an adapter.

5. The lip assembly according to claim 2 wherein the excavating equipment component comprises a generally V-shaped shroud.

* * * * *